United States Patent [19]

Magee

[11] Patent Number: 4,776,432

[45] Date of Patent: Oct. 11, 1988

[54] AUTOMATIC ELEVATOR HALL CALL DELAY APPARATUS

[76] Inventor: John E. Magee, 85 Milford Point Rd., Milford, Conn. 06460

[21] Appl. No.: 155,296

[22] Filed: Feb. 12, 1988

[51] Int. Cl.[4] ..... B66B 1/46

[52] U.S. Cl. ..... 187/121

[58] Field of Search ..... 187/121, 122, 124, 125

[56] References Cited

U.S. PATENT DOCUMENTS

| | | | |
|---|---|---|---|
| 2,944,634 | 7/1960 | Magee | 187/125 |
| 3,511,344 | 5/1970 | De Lamater | 187/121 |
| 3,774,728 | 11/1973 | Metzler et al. | 187/121 |
| 4,126,849 | 11/1978 | Mente et al. | 187/121 |
| 4,230,206 | 10/1980 | Brooks | 187/121 |

*Primary Examiner*—William M. Shoop, Jr.
*Assistant Examiner*—W. E. Duncanson, Jr.
*Attorney, Agent, or Firm*—Brooks, Haidt, Haffner & Delahunty

[57] ABSTRACT

In an automatic elevator system which has a plurality of elevator cars, manually operable buttons at floors to register hall calls and control circuits for controlling the movement of the elevator cars, the improvement which includes time delay circuits intermediate the buttons and the control circuits for causing the control circuits to recognize the registration of a hall call but which will delay the response of the control circuit, and hence, the stopping of a car at the floor at which a hall call has been registered, until a predetermined time after such hall call has been registered.

6 Claims, 1 Drawing Sheet

AUTOMATIC ELEVATOR HALL CALL DELAY APPARATUS

This invention relates to automatic elevator systems having one or more elevator cars and particularly, to the delay of the response of a car or cars to the operation of a hall call switch or button.

In the prior art, it has been the practice with some car dispatching systems, particularly solid state systems known as "overlays", to assess the positions and directions of elevator cars relative to a registered hall call and to assign a car which is disposed so that it can respond to a newly registered hall call in the least time to answer or respond to the newly registered hall call, i.e. the car so disposed travels to the floor at which the newly registered call is registered, stops and opens its door or doors to receive a passenger at such floor.

In such prior art systems, the calls cause reversal of descending and ascending cars, and frequently this occurs without through travel of a car to a terminal. Thus, calls at many floors are responded to relatively promptly which is satisfactory for the intending passengers at such floors. However, bunched traffic demand or calls results in bunched orientation of all elevators in the system. Although many fast responses lowers the average waiting time at the floors significantly, nevertheless, responses to other calls are delayed and the number thereof can increase. As an example, nine hall calls may be responded to in ten seconds and a tenth hall call may not be responded to for 110 seconds, an average of 20 seconds for all ten calls. More equitable service results if all ten calls are responded to in substantially equal times, e.g. 20 seconds.

One object of the invention is to provide substantially equal times of response to all hall calls.

In accordance with a preferred embodiment of the invention, a delay device, such as time delay relays are inserted between the conventional circuits which control an elevator car and its response and the hall call switch or button so that response of a car to a registered hall call is delayed. The delay time may be the same or different for each floor, but preferably, the delay time is the same for each floor. In this way, immediate, or almost immediate response, to a hall call is prevented to more equitably distribute service.

Figure 1:
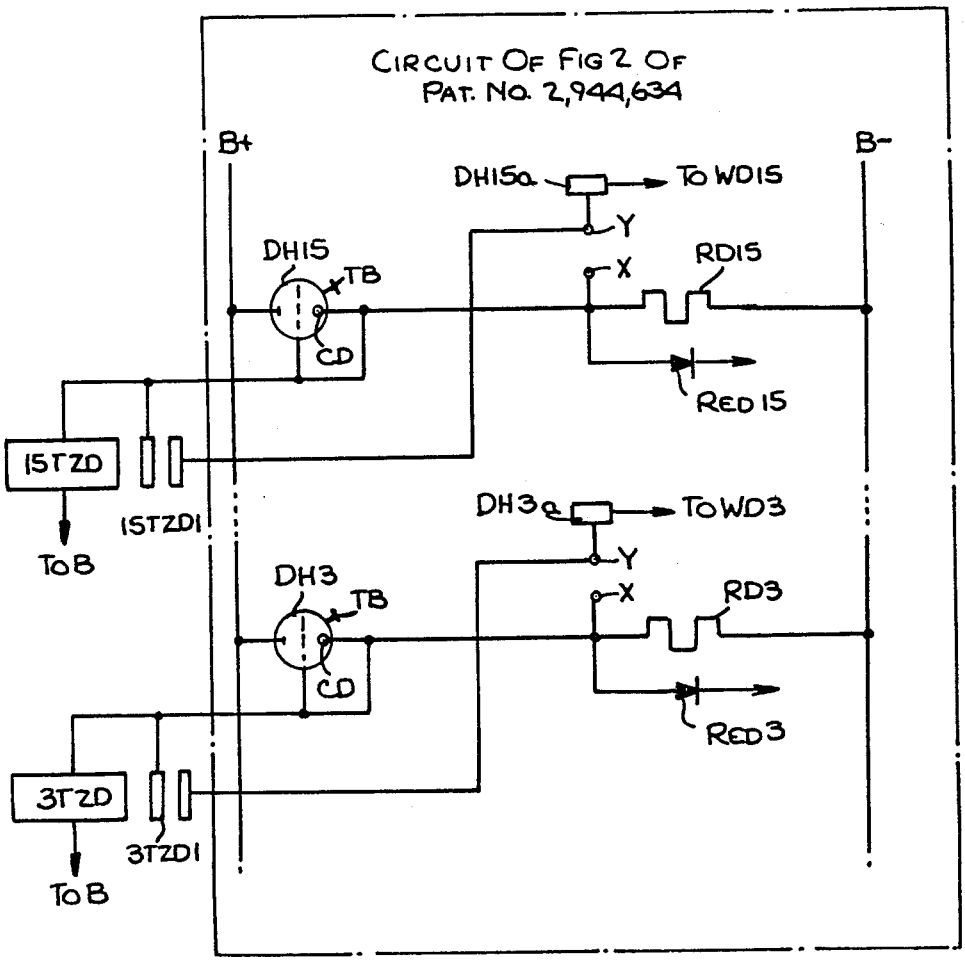
Figure 2:
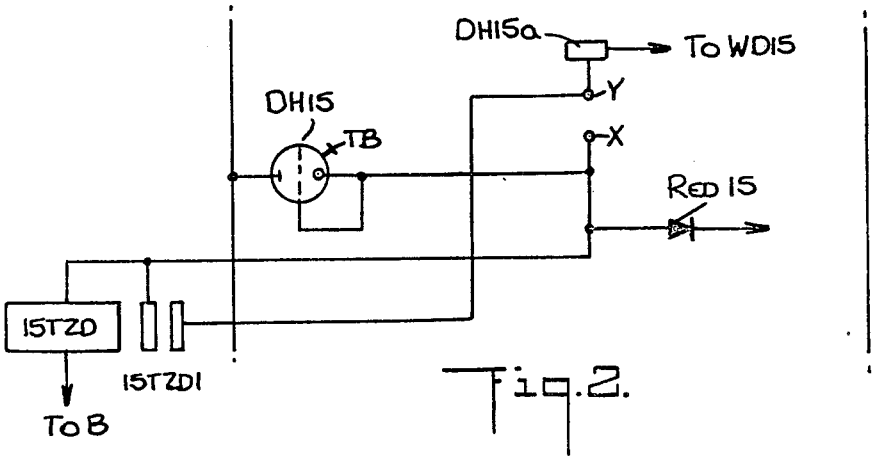

Other objects and advantages of the invention will be apparent from the following detailed description of a preferred embodiment thereof which description should be considered in connection with the accompanying drawing, in which:

FIG. 1 illustrates by way of a circuit diagram a modification of the circuits of a prior art automatic elevator system to include the invention; and FIG. 2 is a partial circuit diagram of an alternative embodiment of the invention.

Although the invention will be illustrated in connection with the elevator car control and dispatching system shown and described in U.S. Pat. No. 2,944,634, it will be apparent to those skilled in the art that the invention may be used with other control and dispatching systems. Generally speaking, the invention replaces the portion of such systems which cause an immediate response of the systems to the operation of a hall call device by an intending passenger by delay means which delays such response for a predetermined time.

Although the use of the invention in connection with the hall call devices operated by an intending passenger desiring a lower floor (down hall call), will be described, it will be apparent to those skilled in the art that the invention may also be used in connection with those such devices which are used to register demands for service to a higher floor.

As described in said U.S. Pat. No. 2,944,634, each floor or landing, except the top floor, is provided with up call registering means (up landing call button UH not shown in the accompanying drawing), and each floor, except the first floor, is provided with down call registering means, a down landing call button DH. Such buttons are in the form of gas tubes which act as switches and conduct when the button TB thereof is touched by an intending passenger. Of course, other manually responsive switching devices may be used.

When a button DH is touched by an intending passenger, a call in the down direction is registered, and the car control circuits described in said patent immediately respond as described in said patent.

FIG. 1 illustrates only the down hall buttons of said patent for floors 3 and 15, and the components electrically immediate thereto, but the invention may be similarly applied to the buttons for other floors or all the floors.

As shown and described in said patent, the touching of a DH button, registers a demand for downward transport. If it is assumed that the DH15 button has been touched, a demand for downward transport has been registered at the 15th floor which is retained through the RD15 resistor. Each elevator car of the elevator car group is raised and lowered by conventional hoisting apparatus, and the system includes a conventional selector machine for each car which may be operated from the hoisting motor drive shaft or by a cable or tape which moves with the car. The selector machine for car a has contacts DH3*a*, DH15*a*, etc. which are connected to the corresponding selector contacts of the selector machine for the other cars to cause any of the cars to stop for the registered 15th floor down call. When the DH15 button is touched, the DH15*a* contact, as well as the corresponding contacts for other cars, is energized so that when the selector brush of a car contacts the DH15 contact, a responding car stops at the floor and opens its doors to receive a passenger. Thereafter, the doors close, and the elevator car resumes its normal operation.

It will be observed that the cathode CD of each button DH is connected to both the resistor RD and the DH contact in the circuit of said patent. For providing the delayed response of the preferred embodiment of the invention, the interconnection between the DH contact on the one hand, and the cathode CD and the RD resistor, on the other hand, is interrupted at the points X and Y and replaced by time delay means in the form of an adjustable time delay relay, 3TZD, 15TZD, etc. with contacts 3T2DL, 15T2D1, etc. so that the DH contacts are not energized until after the time delay relay has timed out, e.g. a time which may be of the order of ten seconds, and the contacts TD have closed. Therefore, for a period of time after a DH button is pushed, determined by the time delay of the TZD relay, the DH contacts will not be energized and will not cause stopping or reversal of direction, of an elevator car at the fooor where the DH button is touched. However, after the TZD relay times out, the response of a car will be as described in said patent.

The line designated as WD in the drawing, e.g. WD15, which connects to a corresponding WD in said patent (FIG. 4) and U.S. Pat. No. 3,078,962 (FIG. 1) could be connected to the cathode CD of a button DH for fast response of group control in which case only response of individual elevator cars would be delayed.

If the coil of the TZD relay has sufficient resistance, e.g. a resistance sufficient to perform the function of the RD resistor show in said U.S. Pat. No. 2,944,634, the coil of the added TZD relay may replace the RD resistor, as illustrated in FIG. 2, at each of the floors where a delayed response is to be provided. FIG. 2 illustrates the modification of the circuit of FIG. 1 for only the 15th floor, but similar modifications can be used at other floors.

In FIG. 2, the RD15 resistor is replaced by the coil of relay 15TZD, and the contacts 15TZD1 are connected as they are connected in FIG. 1. The operation of the alternative embodiment of FIG. 2 is the same as that described in connection with FIG. 1.

While the invention has been described in connection with hard wired circuits, it is obvious that the principles of the invention may be applied to other types of circuits, such as "sold state" circuits. Thus, the relays TZD and their contacts may be replaced by solid state delay circuits, and the delay of operation provided thereby, or by the relays TZD, may be supplied to solid state circuits of a known type for controlling the response of a car or cars to a hall call.

Although preferred embodiments of the present invention have been described and illustrated, it will be apparent to those skilled in the art that various modifications may be made without departing from the principles of the invention.

I claim:

1. In an elevator system comprising at least one elevator car available to serve a plurality of landings, hoisting means for moving said car to and from said landing, call registering means at said landings for registering demands by intending passengers for service at said landing and control circuits connected to said call registering means and responsive thereto for causing said hoisting means to move said car to a landing where a call is registered, wherein the improvement comprises a plurality of time delay means each operable by one of at least some of said call registering means and connected to said control circuits for delaying the response of said control circuits to the registration of demands for service at the respective ones of said at least some of said call registering means.

2. An elevator system as set forth in claim 1 wherein each of said time delay means comprises a time delay relay having contacts operable after a predetermined time by an operating coil, said contact being connected between each of said at least some of said call registering means and at least a portion of said control circuits and said operating coil being connected to each of said at least some of said call registering means.

3. An elevator system as set forth in claim 1 wherein said call registering means is means for registering a demand for service in the downward direction.

4. An elevator system as set forth in claim 1 wherein said control circuits include a contact engageable by a brush, the position of which is controlled by said elevator car, and wherein said call registering means is a switch and wherein said time delay means is connected electrically in series with said call registering means and said contact.

5. An elevator system as set forth in claim 1 wherein said system includes a plurality of elevator cars serving said plurality of landings, a plurality of said hoisting means, one for each car, for moving said cars to and from said landings and said control circuits control the movement and dispatching of each of said cars.

6. An elevator system as set forth in claim 1 wherein each time delay means is operable by a different one of said call registering means and is connected to said control circuits for preventing the stopping of a car at a landing where a demand for service has been registered until after a predetermined time from the time that a demand for service has been registered at the last-mentioned said landing.

* * * * *